United States Patent [19]

Sartorio

[11] Patent Number: 4,806,071

[45] Date of Patent: Feb. 21, 1989

[54] METHOD OF UNSTACKING METAL SHEETS

[75] Inventor: Franco Sartorio, Turin, Italy

[73] Assignee: Prima Industrie S.p.A., Turin, Italy

[21] Appl. No.: 140,605

[22] Filed: Jan. 4, 1988

[30] Foreign Application Priority Data

Jan. 16, 1987 [IT] Italy ..... 67022 A/87

[51] Int. Cl.[4] ..... B65H 3/46

[52] U.S. Cl. ..... 414/786; 271/91; 271/262; 414/796; 414/797

[58] Field of Search ..... 414/112, 114, 115, 117, 414/118, 121, 122, 786; 271/91, 93, 95, 262

[56] References Cited

U.S. PATENT DOCUMENTS 2,743,923 5/1956 Watter ..... 271/91 X 4,516,762 5/1985 Moltrasio et al. ..... 414/121 X

*Primary Examiner*—Leslie J. Paperner

*Attorney, Agent, or Firm*—Shlesinger, Arkwright & Garvey

[57] ABSTRACT

A method whereby a pack of metal sheets adhering to one another is suspended on upper gripping elements of an upper vertically-mobile element beneath which is fed forward a lower transversely-mobile element having lower gripping elements. The upper and lower gripping elements are caused to interact in such a manner as to divide the pack into two parts by raising the upper element; and the lower element is backed up so as to feed on to a production line the part of the pack consisting of a single sheet, and/or to feed on to a reject bed the part of the pack consisting of a number of inseparable sheets.

13 Claims, 4 Drawing Sheets

METHOD OF UNSTACKING METAL SHEETS

BACKGROUND OF THE INVENTION

The present invention relates to a method of unstacking metal sheets.

In industries such as the car industry, in which products are manufactured starting from metal sheets, the said sheets are fed on to the production lines in stacks, from which they are usually unstacked and fed one at a time on to production machines.

Removing a single sheet of the top of the stack is not always an easy job, due to the sheets usually being surface treated with rustproofing oil or grease. At the stacking stage, the air between adjacent sheets is usually expelled by the weight of the sheet/s on top, thus resulting in the formation of a continuous film of lubricating material between the said adjacent sheets. Besides preventing air from entering between the sheets, the said continuous film eventually becomes rubbery, with the result that adjacent sheets are actually glued together.

For assisting the removal of single sheets off a stack, various methods have been proposed, whereby suckers, preferably applied to the corners of the top sheet, are either raised continuously or in oscillating member, so as to separate the top sheet from the one underneath.

According to known methods, separation of adjacent sheets is also assisted by means of air jets, used either singly or in conjunction with the said suckers, and directed crosswise in relation to the edges of the sheets, so as to replace the air expelled between one sheet and the next.

An alternative method consists in the use of toothed blades, which are pressed against the sides of the stack, and then moved upwards so as to hook up and raise the top sheets.

When working with sheets of magnetic material, separation is also known to be assisted using magnets having a transverse magnetic field in relation to the sheets.

The aforementioned methods usually also comprise sensors for detecting whether or not the top sheet has been separated successfully and, if it has not, for repeating the separating cycle. If, after a given number of repeat cycles, the top sheet still fails to be separated successfully, the said sensors emit an emergency signal for arresting the entire production line until the fault is rectified by the operator.

In addition to being unreliable, due to the relative frequency with which the top sheet fails to be separated, a major drawback of the aforementioned known methods is that they fail to prevent stoppage of the production line each time the said top sheet fails to be separated. Such a drawback therefore rules out any possibility of the aforementioned methods being employed on fully automated lines with no supervising personnel.

SUMMARY OF THE INVENTION

The aim of the present invention is to provide a method of unstacking metal sheets, which provides, not only for maximising efficiency, but also for automatically rectifying non-separation of the sheets, without arresting the relative production line.

With this aim in view, according to the present invention, there is provided a method of unstacking metal sheets, characterised by the fact that it comprises stages consisting in:

removing a pack of the said sheets of the said stack;

feeding the said pack, comprising at least one said sheet, between an upper and lower element having respective de-activatable upper and lower gripping means designed to cooperate respectively with a top and bottom sheet in the said pack;

performing at least one separating cycle comprising at least a first stage consisting in bringing together the said upper and lower elements in a first direction substantially perpendicular to the said sheets, so as to cause the said upper and lower gripping means to cooperate actively with the said top and bottom sheets; and at least a second stage consisting in parting the said upper and lower elements in the said first direction, while at the same time maintaining the said gripping means in the said active condition, so as to divide the said pack into a first part connected to the said upper element, and a second part connected to the said lower element;

de-activating the said gripping means on the said lower element;

performing a first unloading cycle consisting in unloading the said second part of the said pack off the said lower element;

bringing together the said upper and lower elements so as to release the said first part of the said pack on to the said lower element, after first de-activating the said upper gripping means; and performing a second unloading cycle consisting in unloading the said first part of the said pack off the said lower element.

Should the said first and/or second part of the pack consist of a single sheet, the relative unloading cycle obviously consists in feeding the said separated sheet on to a production line.

Clearly, therefore, the aforementioned method not only provides for greater separating efficiency, by virtue of subjecting the pack to the opposite pull exerted by the said upper and lower elements, but also prevents any possibility of the production line being arrested in the event of failure to separate a single sheet from the said pack. In fact, according to the above method, all the sheets in the pack are unloaded regardless of whether or not a single sheet is separated, thus enabling a further attempt to be made on another pack.

In other words, under no circumstances does the separating device become jammed with a group of inseperable sheets, thus resulting in stoppage of the production line.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
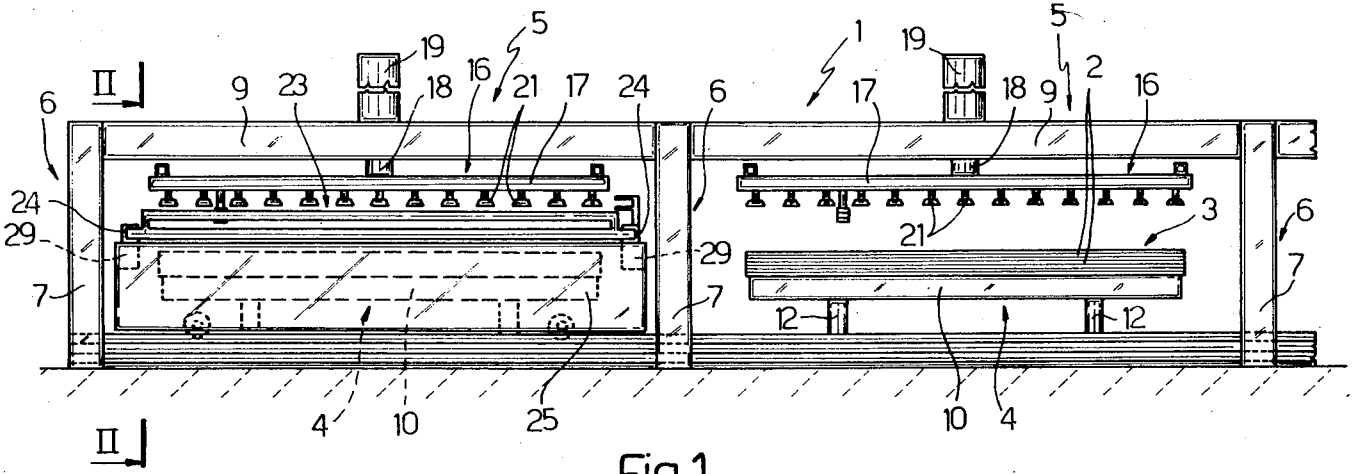
FIG. 1 shows a side view of a system featuring the method according to the present invention.
Figure 2:
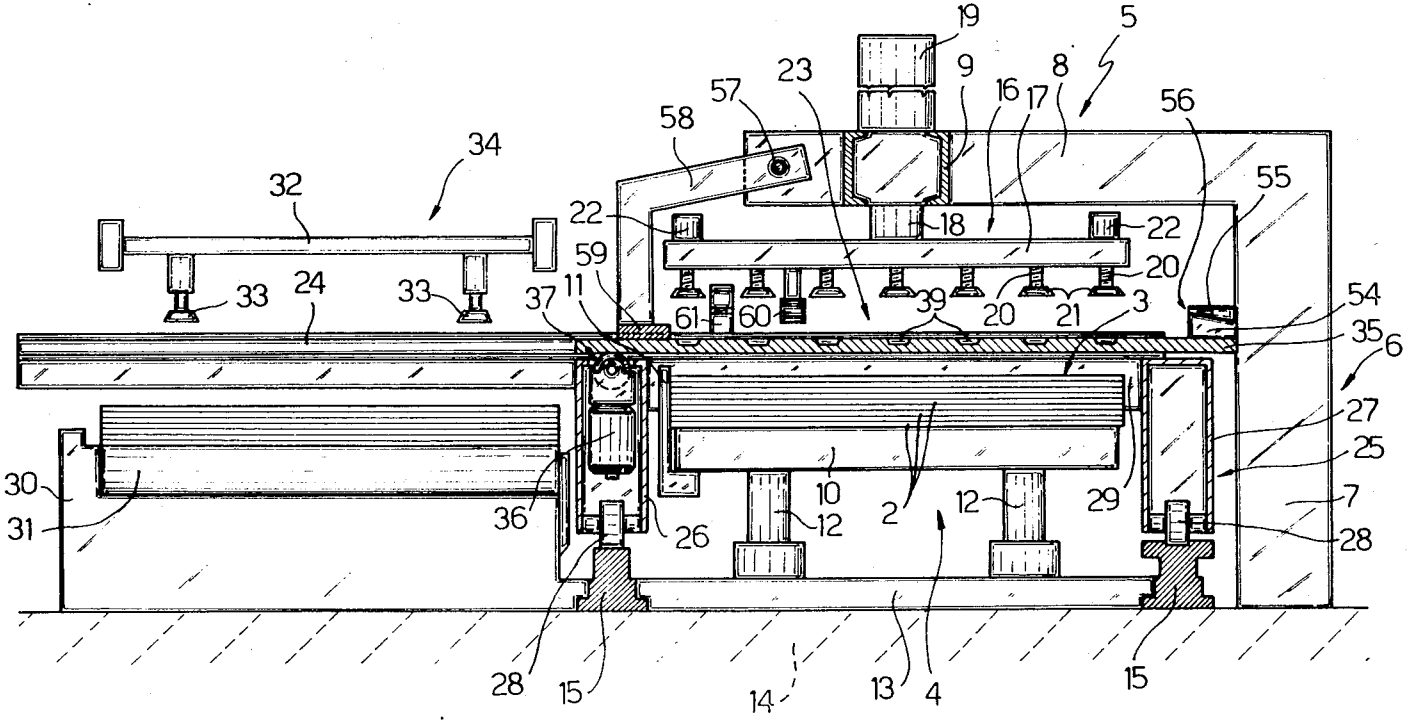
FIG. 2 shows a schematic section along line II—II in FIG. 1.

Number 1 in FIGS. 1 and 2 indicates a system for separating metal sheets 2 from stacks 3 fed on to supports or base elements 4 forming part of respective side-by-side separating units 5.

Each separating unit 5 comprises two substantially L-shaped gantries 6, each consisting of a vertical pillar 7 and a horizontal arm 8 extending from the top end of respective pillar 7. Respective intermediate points on the said arms 8 are connected by a horizontal cross member 9 perpendicular to both pillars 7 and horizontal arms 8, and common to both units 5.

As shown, particularly in FIG. 2, each element 4 comprises a horizontal, substantially rectangular plate 10 designed to support a respective stack 3 and having, on the end opposite that facing pillars 7, a stop element 11 for positioning sheets 2 on the said plate 10. The said plate 10 is supported on vertical actuators 12 designed to move it between a raised position, as shown in FIG. 2, and a lowered position (not shown) wherein plate 10 substantially contacts a bed 30 anchored to foundation 14 and situated between two rails 15 extending parallel with cross member 9 and through both units 5.

Over respective element 4, each unit 5 comprises an upper element 16 comprising a flat, substantially rectangular plate 17 located over plate 10 and secured centrally to the bottom end of a rod 18 on a vertical actuator 19 connected to the mid point of cross member 9.

As shown, particularly in FIG. 2, from the bottom surface of plate 17 there extend downwards a series of rods 20, preferably arranged in rows (only one of which is shown) and to the bottom end of each of which is connected a sucker 21 connected pneumatically, in known manner, to a known suction system (not shown).

At least some of rods 20 located along the edges of plate 17 extending parallel with cross member 9 consist of the output members of respective vibrators 22 designed, when activated, to move respective rods 20 rapidly in axially-oscillating manner.

As shown, particularly in FIG. 2, a lower element 23, common to both units 5, may be positioned selectively in the space between each element 4 and respective upper element 16. The said lower element 23 is mounted in sliding manner on a pair of horizontal slideways 24 extending perpendicular to cross member 9 and separated by a distance greater than the dimension of each element 4 in the direction of cross member 9. Slideways 24 are supported on a truck 25 mounted so as to travel along rails 15 and comprising two carriages 26 and 27 having respective bottom rollers 28 for travelling along respective rails 15, and extending parallel with cross member 9 on opposite sides of elements 4. Truck 25 also comprises two horizontal cross members 29 connecting carriages 26 and 27 and extending perpendicular to cross member 9. Cross members 29 are separated by a distance greater than the dimension of each element 4 in the direction of cross member 9, and are located at a height greater than that of elements 4 and respective stacks 3, when the said elements 4 are in the said lowered position.

As shown in FIG. 2, slideways 24 project beyond carriage 26, located furthermost from pillars, 7, and in the space between a bottom unloading bed 30, extending parallel with rails 15 along both units 5 and incorporating a conveyor 31, and a top conveyor 32 having a vertically-mobile suckers 33 for gripping sheets 2. Conveyoor 32 extends parallel with cross member 9 over bed 30, and constitutes the initial element of a line 34 employing sheets 2.

Lower element 23 comprises a substantially rectangular plate 35 designed to travel along slidways 24 by virtue of a motor 36 connected to plate 35 via a rack and pinion connecton 38. Plate 35 is designed to move between a forward position, wherein plate 35 is located between base element 4 and respective upper element 16, and a back-up position wherein plate 35 is located between bed 30 and conveyor 31.

Figure 3:
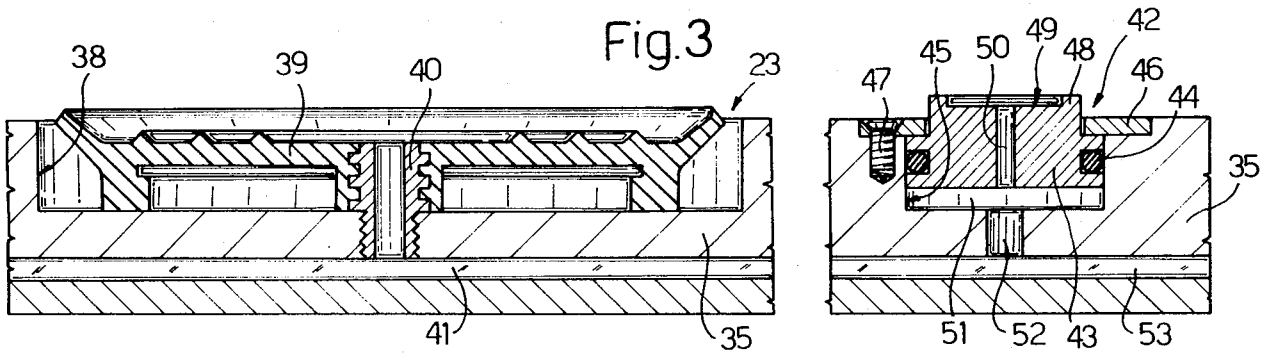
FIG. 3 shows a larger-scale, partially-sectional view of a detail in FIG. 2.

As shown in FIG. 3, plate 35 presents, at the top, a number of cavities 38, each housing a cup-shaped sucker 39 having a centrally-located tubular axial fitting 40 communicating, at the top, with the bottom of respective sucker 39 and, at the bottom, with a suction pipe 41.

Plate 35 also presents, at the top, a number of pneumatic shoes 42, each comprising a piston 43 designed to slide, via the interposition of an airtight seal 44, inside a respective vertical cavity 45 formed on the upper surface of plate 35 and closed at the top by a washer 46 secured to plate 35 by screws 47. Piston 43 presents, at the top, an axial appendix 48 designed to project outside respective cavity 45 through a centre hole on the respective washer 46, and having, at the top, a cavity 49 communicating, via a hole 50 formed axially through piston 43, with the bottom portion of a chamber 51 defined by cavity 45 and respective washer 46. The said chamber 51 communicates at the bottom, via an axial hole 52 formed in plate 35, with a compressed air supply pipe 53. By virtue of the compressed air supplied along pipe 53, each piston 43, if free to move, moves axially between a lowered position, wherein piston 43 contacts the bottom of respective cavity 45 and the top of respective appendix 48 is flush with the upper surface of plate 35, and a raised position wherein respective appendix 48 projects from the upper surface of plate 35 by a distance generally inversely proportional to the weight of sheets 2 on plate 35. As shown in FIG. 2, on the end facing pillars 7, plate 35 presents two lateral shoulders 54 extending vertically upwards from the upper surface of plate 35, and fitted with the opposite ends of a substantially triangular-section separating palte 55, the inside of which is hollow and communicates with a compressed air supply which comres out of plate 55 through a linear nozzle 56 formed along the edge of plate 55 facing bed 30.

The free end of each arm 8 of each unit 5 is fitted with a horizontal pin 57 parallel with cross member 9 and constituting the pivot of a respective downturned, substantially L-shaped arm 58. The free bottom ends of arms 58 on each unit 5 are connected by a horizontal stop bar 59 extending parallel with cross member 9 and designed to move, by virtue of actuating means (not shown) connected to respective arms 58, between a lowered position as shown in FIG. 2, wherein bar 59 is substantially flush with the upper surface of plate 35 and directly over stop element 11, and a raised position wherein bar 59 is substantially higher than upper element 16.

According to a first preferred embodiment as shown, particularly, in FIG. 2, each upper element 16 and lower element 23 present respective sensors 60 and 61, each designed to emit control signals differing according to whether respective element 16 or 23 is empty, or loaded with one sheet 2, or two or more sheets 2.

Sensor 60 is also designed to emit a further signal, should the sheets 2 connected to suckers 21 form a pack 62 (FIG. s 4 and 5) exceeding a given maximum thickness. According to a second embodiment, sensor 61 is designed solely to detect the presence or absence of one or more sheets 2 on element 23; the actual number of sheets 2 present on element 23 being detected by sensor 60 on a difference basis.

Finally, according to a third embodiment, sensors 60 and 61 are of the type described in the said second embodiment, except that sensor 60 is not designed to detect the number of sheets 2 present on element 23 on a difference basis.

Operation of each unit 5 will now be described with reference

Figure 4A:
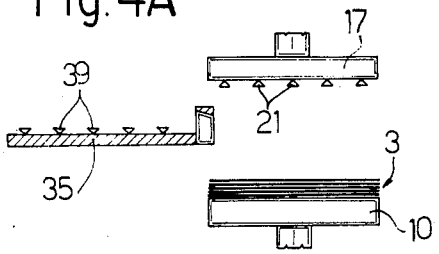
FIGS. 4 and 5 show various operating cycles of the system in FIGS. 1 to 3.

FIG. 4A shows unit 5 in the starting position of the separating cycle, wherein plate 10 is in the lowered position supporting a stack 3 of sheets 2; upper plate 17 is in the raised position; and plate 35 is in the back-up position. At this initial stage of the cycle, stop bar 59 (not shown) is in the raised position.

In the next stage shown in FIG. 4B, plate 10 moves up to bring the top of stack 3 just below the travelling level of plate 35, while upper plate 17 is lowered, and, at the same time, suckers 21 activated, so as to adhere to the top of stack 3.

Figure 4B:
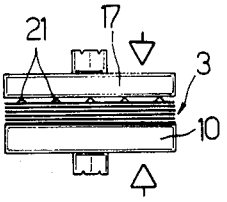
Figure 4C:
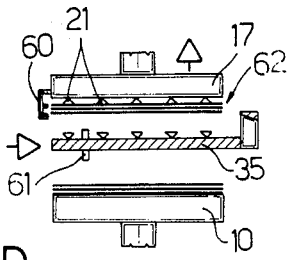

In the next stage shown in FIG. 4C, upper plate 17 is raised, so as to remove a pack 62 of sheets 2 clinging to suckers 21.

At this point, sensor 60 detects the presence and consistency of pack 62, and emits signals for controlling subsequent operation of unit 5.

Should sensor 60 detect no sheets 2 clinging to suckers 21, it emits a zero presence signal for repeating the operating stages shown in FIGS. 4B and 4C.

Should sensor 60 detect a pack 62 exceeding a given maximum thickness, it emits a reject signal causing plate 35 to be moved forward beneath upper plate 17, and unit 5 to perform the reject cycle shown in FIGS. 5C–5G.

The said reject cycle is performed as follows.

Figure 5A:
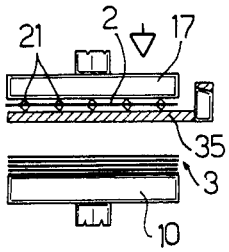
Figure 5B:
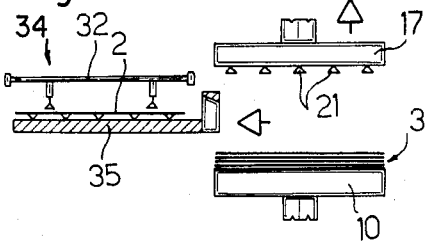
Figure 5C:
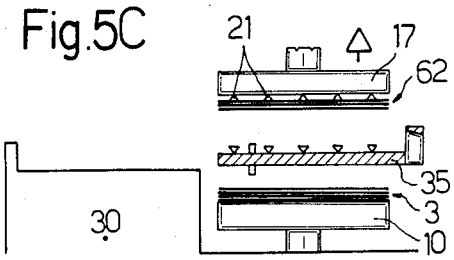
Figure 5D:
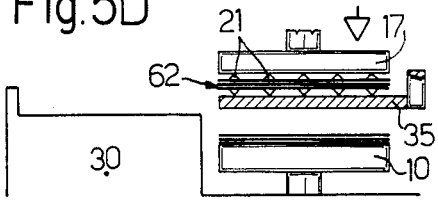
Figure 5E:
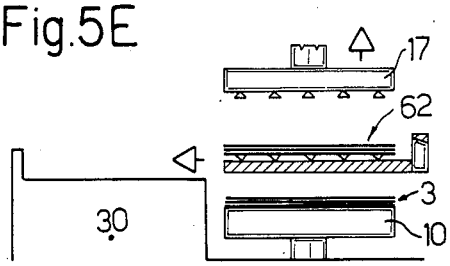
Figure 5F:
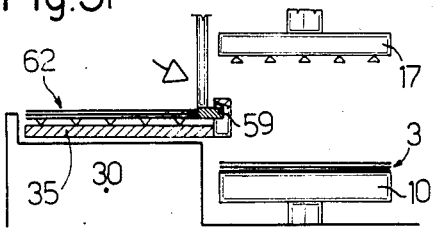

At the FIG. 5C stage, upper plate 17 supports, on suckers 21, the said reject pack 62 raised over plate 35. As shown in FIG. 5D, upper plate 17 is lowered on to plate 35 and then raised back up again (FIG. 5E), after deactivating suckers 21, so as to release pack 62 on to plate 35. As shown in FIG. 5F, plate 35 is backed up over bed 30, after which, bar 59 is lowered so as to contact the side surface of pack 62 facing pillars 7. At this point, pneumatic shoes 42 are activated for pneumatically supporting pack 62 on plate 35, which (FIG. 5G) is moved forward underneath upper plate 17 so as to cause pack 62 to slide off palte 35 and on to underlying bed 30 by virtue of the contact between pack 62 and bar 59. Subsequent activation of conveyor 31 causes rejected pack 62 to be carried off bed 30 and into a parking area (not shown) for rejected sheets 2.

If, on the other hand, sensor 60 detects a pack 62 consisting of a single sheet 2 at stage 4c, it emits a first operating signal causing unit 5 to perform the supply cycle shown in FIGS. 5A and 5B.

The said supply cycle is performed as follows;

As shown in FIG. 5A, plate 35 is moved forward underneath upper plate 17, which is lowered on to plate 35 so as to release the said single sheet 2 on to the same, subsequent to de-activating suckers 21. As shown in FIG. 5B, plate 35 is then backed up underneath conveyor 32, which carries off sheet 2 on to line 34.

Again with reference to the FIG. 4C stage, we shall now examine the commonest case in which sensor 60 detects a pack 62 consisting of more than one sheet 2, but of less than the said maximum thickness. In this case, sensor 60 emits a second enabling signal causing unit 5 to perform the separating cycle shown in FIG. S 4C–4H.

The said separating cycle is performed as follows.

Firstly, the FIG. 4C stage is completed by moving plate 35 forward underneath upper plate 17. With plates 17 and 35 still in the FIG. 4C position, a first attempt is then made to separate sheets 2 by activating vibrators 22 (FIG. 2).

Subsequent to the said first attempt, bottom sensor 61 is activated, which may be of the type described with reference to the said first and second embodiments, or the said third embodiment.

In the case of the said first or second embodiment, should sensor 61 detect on plate 35, either singly or on a difference basis in conjunction with sensor 60, the presence of a single sheet 2 detached from the bottom of pack 62, it emits a first operating signal causing unit 5 to perform the part of the supply cycle shown in FIG. 5B.

Should sensor 61, on the other hand, detect on plate 35 that more than one sheet 2 has been detached from pack 62, it emits a second operating signal causing unit 5 to perform the part of the separating cycle shown in FIGS. 4B–4H and hereinafter referred to as the "reset cycle".

In particular, bar 59 (FIG. 4E) is lowered, while, at the same time, suckers 39 are de-activated and pneumatic shoes 47 activated (FIG. 3). Subsequently (FIG. 4F), plate 35 is backed up (FIG. 4G) so as to cause sheets 2 to slide back on to the top of stack 3, by virtue of bar 59.

Figure 4D:
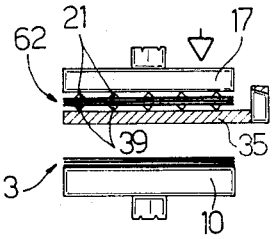
Figure 4E:
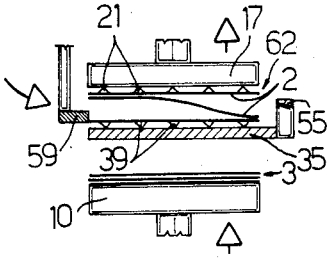
Figure 4F:
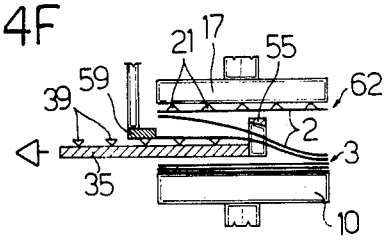
Figure 4G:
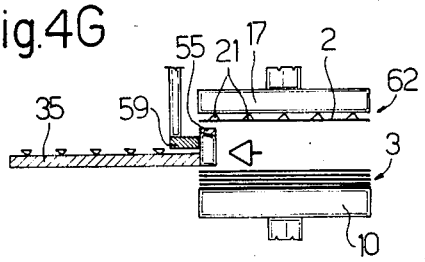
Figure 4H:
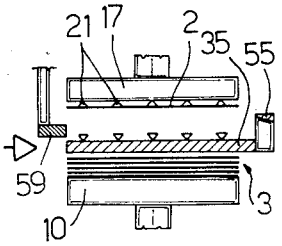

In the event of sheets 2 being only partially detached from the bottom of pack 62, as shown in FIGS. 4E and 4F, plate 55 and the air jet emitted by respective nozzle 56 (FIG. 2) are operated as plate 35 is backed up, so as to fully detach the said sheets 2, which then drop down on to the top of stack 3.

In connection with plate 55, it should be pointed out that, according to a variation not shown, this may be detached from plate 35 and activated by independent actuators controlled by optical sensors designed to detect the presence of partially-detached sheets 2. In this case, plate 55 may be connected, to advantage, to another similar plate designed to move in the direction of rails 15 by virtue of respective actuators controlled by respective optical sensors. Generally speaking, of course, only one of the said plates will be activated at one time, depending on the manner in which sheets 2 are partially detached. If, as described in connection with the said third embodiment, sensor 61 is not designed, either alone or in conjunction with sensor 60, to detect the number of sheets 2 on plate 35, but only the presence or absence of the same, unit 5 still performs a reset cycle whenever sensor 61 detects the presence of at least one sheet 2 on plate 35.

Figure 5G:
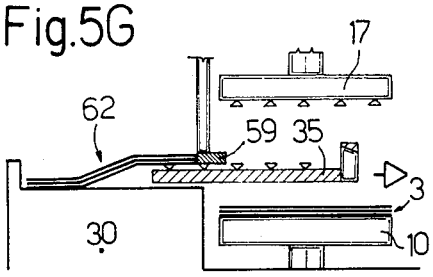

Finally, should sensor 61 detect no sheets 2 on plate 35, it emits a zero signal causing upper plate 17 to be lowered on to plate 35, as shown in FIG. 4D, and simultaneous activation of suckers 39. As shown in FIG. 4E, upper plate 17 is then raised, with suckers 21 and 39 still activated. Such raising of upper plate 17 may lead to a number of different situations:

Sensors 60 or 61 emits a zero signal indicating that pack 62 has not been separated, in which case, the FIG. 4D and 4E stages are repeated. If, after a given number of repeats, either of sensors 60 and 61 continues to emit a zero signal, pack 62 is considered inseperable, and unit 5 performs the full reject cycle shown in FIGS. 5C–5G, if pack 62 is connected to suckers 21, or only part of the reject cycle as shown in FIGS. 5E–5G, if pack 62 is connected to suckers 39.

Sensor 60 or 61 emits a signal indicating the presence of one sheet 2. In this case, if the signal is emitted by sensor 61, unit 5 performs part of the supply cycle as shown in FIG. 5B. In the case of the said third embodiment, however, unit 5 performs a reset cycle. If, on the other hand, the said signal is emitted by sensor 60 unit 5 performs the reset cycle shown in FIGS. 4E–4H, followed by the supply cycle shown in FIGS. 5A and 5B.

Both sensors emit a singals indicating the presence of more than one sheet 2. The emission of these signals indicates that pack 62 has been divided into two parts, neither of which can be supplied directly on to line 34. In this case, unit 5 performs the reset cycle shown in FIGS. 4E–4H, and then moves back into the FIG. 4C position for repeating the separation cycle relative to the part of pack 62 attached to suckers 21, until the said part runs out. Unit 5 then repeats the entire cycle described above with reference to FIGS. 4 and 5, until the whole stack 3 runs out. Once the first stack 3 runs out, lower element 23 is moved along rails 15 on to another unit 5 of system 1, so as to handle another stack 3.

If assisted by appropriate logic (of simple design and within the scope of a standard electronics technician) designed to cope with the output signals of sensors 60 and 61 as described above, system 1 clearly provides for unstacking, according to a given sequence and fully automatically, a given number of stacks 3 of metal sheets 2, without incurring stoppages which would automatically result in stoppage of line 34. Such a favourable result is achieved by virtue of the fact that, on each unit 5, lower element 23 interacts actively with upper element 16 for separating a pack 62 of sheets 2 removed by element 16 from stack 3, by feeding groups of sheets 2 detached from the bottom of pack 62 back on to stack 3; by feeding single detached sheets 2 on to line 34; and by feeding inseperable parts of pack 62 on to a reject line consisting of bed 30 and conveyor 31.

In particular, it should be pointed out that groups of sheets 2 are fed on to the said reject line or on to the top of stack 3 by virtue of the interaction between lower element 23 and a single element consisting of bar 59, which, when in the said lowered position, is flush with the upper surface of plate 35 and occupies the space between the position occupied by the edge of sheets 2 facing bed 30 when sheets 2 are located on plate 35 in the said forward position, and the position occupied by the edge of sheets 2 facing pillars 7 when sheets 2 are located on plate 35 in the said back-up position.

According to a first variation (not shown), system 1 comprises one pair of gantries 6 integral with truck 25 and connected by a cross member 9, in turn, supporting a single upper element 16 designed to travel with truck 25 along system 1.

According to a further variation (not shown), system 1 comprises a single unit 5 operating in exactly the same way as unit 5 described above. In the case of a single unit 5, however, rails 15 are dispensed with, and truck 25 is replaced by a corresponding fixed element.

I claim:

1. A method of unstacking metal sheets, characterized by the fact that it comprises stages consisting in:

removing a pack of the said sheets off the said stack;

feeding the said pack, comprising at least one said sheet, between an upper and lower element having respective de-activatable upper and lower gripping means designed to cooperate respectively with a top and bottom sheet in the said pack;

performing at least one separating cycle comprising at least a first stage consisting in bringing together the said upper and lower elements in a first direction substantially perpendicular to the said sheets, so as to cause the said upper and lower gripping means to cooperate actively with the said top and bottom sheets; and at least a second stage consisting in parting the said upper and lower elements in the said first direction, while at the same time maintaining the said gripping means in the said active condition, so as to divide the said pack into a first part connected to the said upper element, and a second part connected to the said lower element;

de-activating the said gripping means on the said lower element;

performing a first unloading cycle consisting in unloading the said second part of the said pack off the said lower element;

bringing together the said upper and lower elements so as to release the said first part of the said pack on to the said lower element, after first de-activating the said upper gripping means; and performing a second unloading cycle consisting in unloading the said first part of the said pack off the said lower element.

2. A method as claimed in claim 1, characterised by the fact that the said pack is removed from the said stack by feeding the said stack on to a base element located beneath the said upper element; the said pack of sheets being removed off the top of the stack by the said upper element subsequent to a first approach movement of the said upper and base elements in the said first direction, so as to cause the said upper gripping means to cooperate actively with the top of the said stack, and subsequent to a second parting movement of the said upper and base elements in the said first direction; the said lower element being moved, in a second direction crosswise in relation to the said first direction, from a forward position beneath the said upper element, to a backup position, laterally displaced in related to the said upper element, for enabling performance of the said first and second movements.

3. A method as claimed in claim 2, characterized by the fact that the said first and second unloading cycles are controlled by sensor means designed to detect both the presence of the said first and second parts of the said pack, and whether one of the said parts comprises one or more said sheets.

4. A method as claimed in claim 2, characterised by the fact that each of the said first and second unloading cycles comprises at least one displacement of the said lower element between the said forward and back-up positions.

5. A method as claimed in claim 2, characterised by the fact that, when the said sensor means detect that at least one of the said parts of the said pack comprises a single said sheet, the respective said unloacing cycle off the said lower element comprises displacement of the said lower element from the said forward position to the said back-up position; and removal of the said single sheet from the said lower element, in the said back-up position, by means for supplying the said sheet on to a production line.

6. A method as claimed in claim 2, characterised by the fact that the said first unloading cycle consists of a stack reset cycle; the said reset cycle comprising stages consisting in placing, over and substantially contacting the said lower element, first stop means designed to cooperate laterally with the said second part of the said pack, for preventing the same from moving, together with the said lower element, from the said forward to the said back-up position; and in moving the said lower element from the said forward to the said back-up position, thus causing the said second part of the said pack to slide laterally along the said lower element, and to fall on to the top of the said stack on the said base element.

7. A method as claimed in claim 2, characterised by the fact that, when the said sensor means detect that the said first part of the said pack on the said lower element comprises at least two said sheets, the said second unloading cycle consists of a reject cycle consisting in moving the said lower element from the said forward to the said back-up position; in placing, over and substantially contacting the said lower element, second stop means designed to cooperate laterally with the said first part of the said pack, for preventing the same from moving, together with the said lower element, from the said back-up to the said forward position; and in moving the said lower element from the said back-up to the said forward position, thus causing the said first part of the said pack to slide laterally along the said lower element, and to fall on to a reject supporting element located beneath the said lower element in the said back-up position.

8. A method as claimed in claim 6, characterised by the fact that the said first and second stop means consist of a single bar extending substantially crosswise in relation to the said second direction; each said unloading cycle comprising displacement of the said bar in a direction substantially parallel with the said first direction and between a raised position in relation to the said lower element and a lowered position wherein the said bar is located substantially contacting the upper surface of the said lower element, and between the positions occupied by the said parts of the said pack, on the said lower element, when the said lower element is in the said forward and back-up positions respectively.

9. A method as claimed in claim 6, characterised by the fact that the said lateral sliding of the said parts of the said pack on the said lower element is assisted by activating pneumatic shoes on the said lower element.

10. A method as claimed in claim 3, characterised by the fact that the said separating cycle is repeated at least one, if the said sensor means detect that one of the said parts of the said pack is absent, and the other said part comprises at least two sheets.

11. A method as claimed in claim 7, characterised by the fact that the said separating cycle is dispensed with and the said reject cycle performed immediately, when the said sensor means detect that the said pack exceeds a given maximum thickness.

12. A method as claimed in claim 1, characterised by the fact that a separating means are moved crosswise in relation to the said first direction, in the space between the said first and second parts of the said pack, upon completion of the said separating cycle, for the purpose of fully separating any sheets only partially separated from the said first part.

13. A method as claimed in claim 12, characterised by the fact that the said separating means are carried on the said lower element, and are moved by the same between the said first and second parts of the said pack during performance of the said first unloading cycle.

* * * * *